US005444423A

United States Patent [19]

Venzke et al.

[11] Patent Number: 5,444,423

[45] Date of Patent: Aug. 22, 1995

[54] LATCH MECHANISM FOR A CIRCUIT BREAKER

[75] Inventors: Donald R. Venzke, Cedar Rapids; Teresa I. Hood, Coralville; Joel L. Miller, Cedar Rapids, all of Iowa

[73] Assignee: Square D, Palatine, Ill.

[21] Appl. No.: 196,345

[22] Filed: Feb. 14, 1994

[51] Int. Cl.[6] ..... H01H 9/20

[52] U.S. Cl. ..... 335/167; 335/172; 335/35

[58] Field of Search ..... 335/167–176, 335/23, 24, 35

[56] References Cited

U.S. PATENT DOCUMENTS

| | | | |
|---|---|---|---|
| 3,265,837 | 8/1966 | Klein | 335/35 |
| 3,943,316 | 3/1976 | Oster . | |
| 3,943,472 | 3/1976 | Oster et al. . | |
| 3,944,953 | 3/1976 | Oster . | |
| 4,417,223 | 11/1983 | Bancalari . | |
| 4,740,768 | 4/1988 | Morris et al. . | |
| 4,789,848 | 12/1988 | Castonguay et al. | 335/172 |
| 4,888,570 | 12/1989 | Toda | 335/167 |
| 5,003,139 | 3/1991 | Edds et al. . | |
| 5,073,764 | 12/1991 | Takahashi et al. . | |
| 5,075,657 | 12/1991 | Rezac et al. . | |
| 5,097,589 | 3/1992 | Rezac et al. . | |
| 5,130,685 | 7/1992 | Arnold et al. | 335/167 |
| 5,159,304 | 10/1992 | Yamagata et al. . | |
| 5,245,302 | 9/1993 | Brune et al. . | |

*Primary Examiner*—Lincoln Donovan

*Attorney, Agent, or Firm*—Kareem M. Irfan; larry I. Golden

[57] ABSTRACT

A latch mechanism for a circuit breaker comprises a pair of longitudinal legs, a lateral section bridging the pair of longitudinal legs, and a longitudinal section extending from the lateral section in an opposite direction relative to the pair of legs. The lateral section includes a lower bearing surface for releasably engaging a cradle of the circuit breaker. The lower bearing surface includes a coined radius for facilitating engagement and disengagement of the cradle. The longitudinal section includes a protrusion for supporting a latch spring. The latch mechanism is manufactured in a single stamping operation, during which the protrusion is formed by cold extrusion.

10 Claims, 14 Drawing Sheets

Mechanism ( on )

Mechanism (on)

MECHANISM ( RESET )

LATCH MECHANISM FOR A CIRCUIT BREAKER

FIELD OF THE INVENTION

The present invention generally relates to circuit breakers, and more particularly, to a latch mechanism for a circuit breaker which provides improvements in terms of operation, ease of manufacturing and assembly, and reliability.

BACKGROUND OF THE INVENTION

Circuit breakers are commonly used for providing automatic circuit interruption upon detection of undesired overcurrent conditions on the circuit being monitored. These overcurrent conditions include, among others, overload conditions, ground faults and short-circuit conditions.

Circuit breakers typically include an electrical contact on a movable arm which rotates away from a stationary contact in order to interrupt the current path. In response to an overcurrent condition, circuit breakers generally move the arm to break the current path by tripping a spring-biased latch mechanism. The latch mechanism includes a bearing surface for supporting a cradle which, in turn, is coupled to the movable arm. Tripping the latch mechanism causes the bearing surface to release the cradle, thereby forcing the arm and its contact away from the fixed contact.

A drawback of some existing latch mechanisms is that the bearing surface of the latch mechanism may fail to release the cradle in response to the latch mechanism being tripped, thereby preventing interruption of the current path during an overcurrent condition. Also, the bearing surface of the latch mechanism may improperly release the cradle without being tripped so as to interrupt the current path during normal operating conditions. In an effort overcome this drawback and achieve proper operation of the latch mechanism, the bearing surface may be lubricated or buffed. This solution, however, is unsatisfactory because it results in relatively large manufacturing tolerances and because it increases the cost of production due to the addition of a separate process step for lubrication or buffing.

Accordingly, there is a need for a latch mechanism for a circuit breaker which overcomes the above-mentioned deficiencies of the prior art.

SUMMARY OF THE INVENTION

The present invention provides a latch mechanism for a circuit breaker which affords improvements in terms of operation, ease of manufacturing and assembly, and reliability.

In one particular embodiment, the latch mechanism comprises a pair of longitudinal legs, a lateral section bridging the pair of longitudinal legs, and a longitudinal section extending from the lateral section in an opposite direction relative to the pair of legs. The lateral section includes a lower bearing surface for releasably engaging a cradle of the circuit breaker. The lower bearing surface includes a coined radius for facilitating engagement and disengagement of the cradle. The longitudinal section includes a protrusion for supporting a latch spring.

The latch mechanism is manufactured in a single stamping operation, during which the protrusion is formed by cold extrusion (i.e., cold forging/pressing). Thus, the coined radius of the bearing surface and the protrusion of the longitudinal section are formed at the same time as the remaining portions of the latch mechanism. The use of a single stamping operation to form the entire latch mechanism tightly controls the manufacturing tolerances associated with the coined radius and the protrusion, reduces production costs, and increases production rates.

BRIEF DESCRIPTION OF THE DRAWING

Other objects and advantages of the invention will become apparent upon reading the following detailed description and upon reference to the drawings in which.

Figure 1:
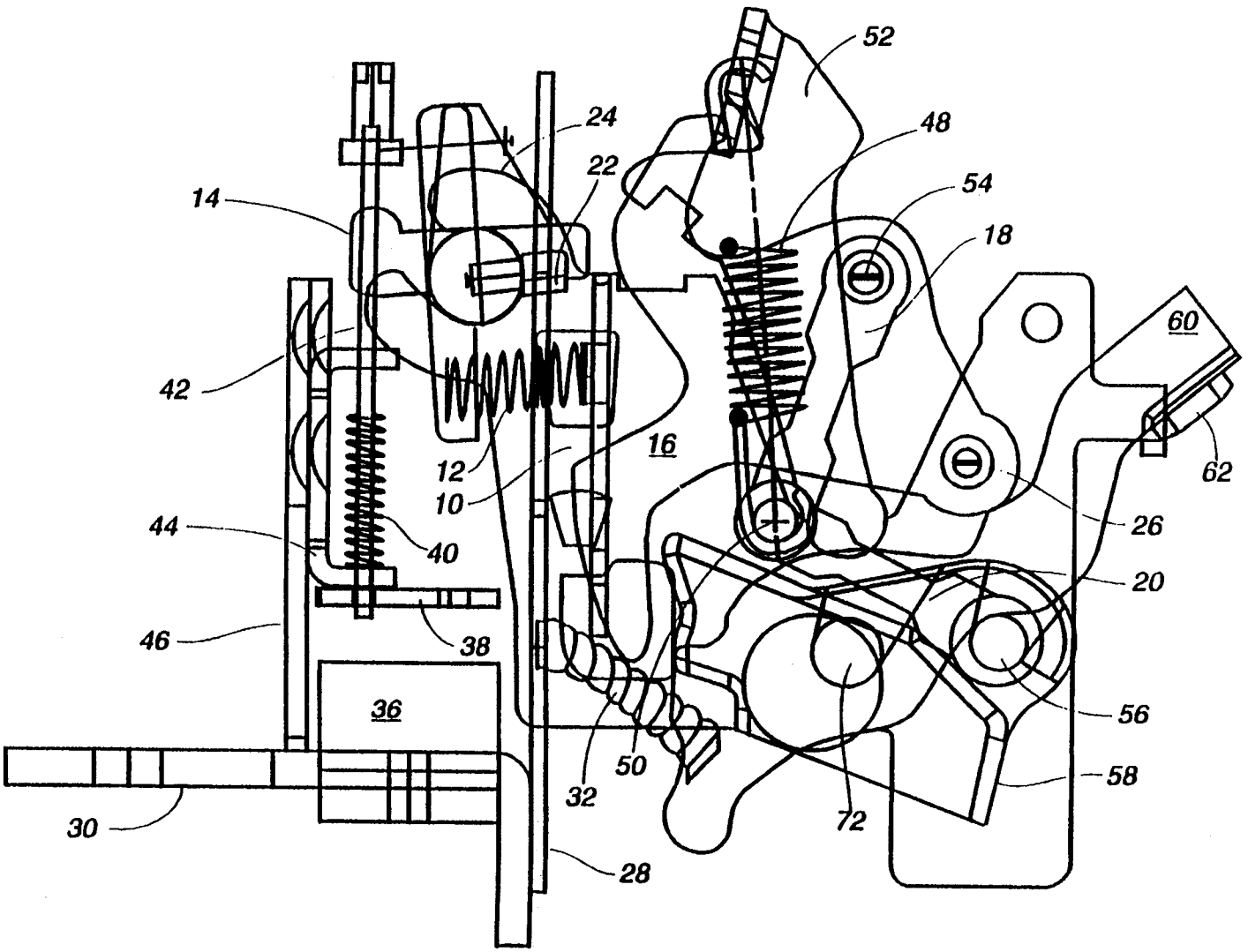
FIG. 1 is a side view of a circuit breaker including a blade suspension assembly embodying the present invention.
Figure 2:
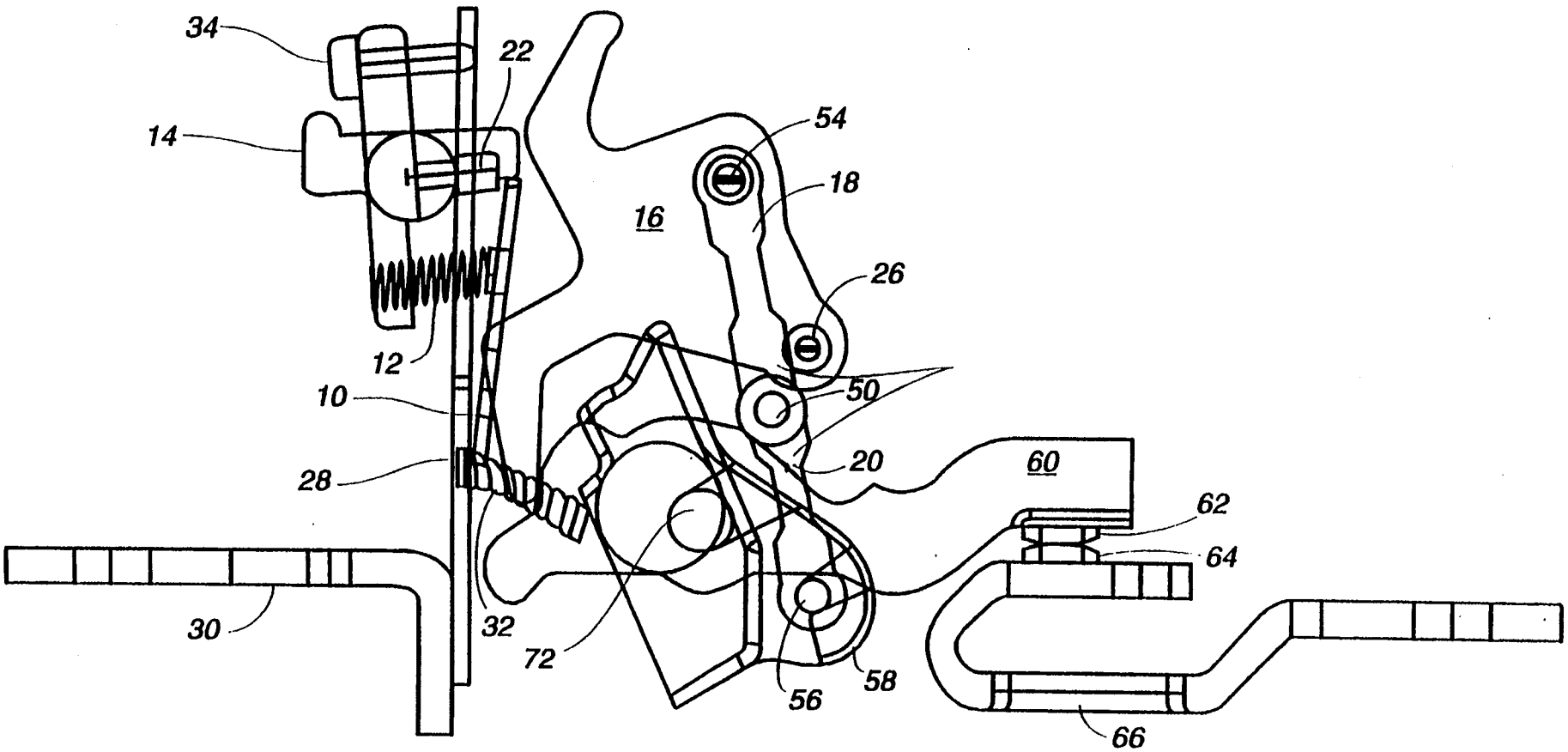
FIG. 2 is a side view of a thermal trip unit of the circuit breaker in FIG. 1, shown in the untripped (or closed/or "on") position.

While the invention is susceptible to various modifications and alternative forms, specific embodiments thereof have been shown by way of example in the drawings and will be described in detail. It should be understood, however, that the described embodiments are not intended to limit the invention to the particular form described. On the contrary, the intention is to cover all modifications, equivalents, and alternatives falling within the spirit and scope of the invention as defined by the appended claims.

DETAILED DESCRIPTION OF THE PREFERRED EMBODIMENT

Turning now to the drawings, the present invention is discussed in the context of an exemplary circuit breaker using a latch mechanism embodying the principles of the present invention. The particular circuit breaker illustrated and described (FIGS. i through 13) should not, however, be construed to limit the possible applications for the present invention, as these applications encompass a wide variety of circuit breaker types. To fully appreciate the utility of the present invention, however, the circuit breaker of FIGS. i through 13 will first be described, followed by a detailed description of a latch mechanism (in accordance with the present invention) generally depicted in the circuit breaker.

The circuit breaker includes a thermal trip unit (FIGS. 2, 3, 6, and 7), a magnetic trip unit (FIGS. 4 through 7), and a blade/cradle assembly (FIGS. 8 through 13). The thermal trip unit and the magnetic trip unit include a common latching system shown in FIGS. 2 through 7. While each of these portions of the circuit breaker are described below by reference to the corresponding drawings, reference may be made to FIG. 1 to view the circuit breaker as a whole.

The latching system (FIGS. 2 through 7) includes a latch 10, a latch spring 12, and a trip crossbar 14. Under normal operating conditions (i.e., the circuit breaker is untripped/closed), the latch 10 holds a cradle 16 in a stationary position such that a pair of parallel upper links 18 are disposed in line with a pair of parallel lower links 20. This is accomplished with the latch 10 being locked over the cradle 16 by a latch pin 22 mounted in the trip crossbar 14. A pair of parallel mechanism frame sides 24 house the latch 10, a cradle pivot pin 26, and the cradle 16.

The upper and lower links 18, 20 are identically constructed parts, which reduces production costs and eliminates the possibility of incorrectly assembling the links 18, 20. Moreover, the mechanism frame sides 24, the links 18, 20, the latch 10, and the cradle 16 are all flat stamped parts produced in a single stamping operation. This allows for automated assembly, thereby reducing production costs and increasing production rate.

In response to the occurrence of a fault condition causing a circuit interruption, the trip crossbar 14 is rotated counterclockwise (as viewed in FIGS. 1 through 5) which, in turn, rotates the latch pin 22 to a position where it is no longer in contact with the top of the latch 10. With the latch pin 22 moved, the force from the cradle 16 against the latch 10 causes the latch 10 to rotate counterclockwise, thereby releasing the cradle 16. The cradle 16 then rotates clockwise to collapse the upper and lower links 18, 20.

With respect to the thermal trip unit (FIGS. 2, 3, 6, and 7), the thermal trip unit operates in response to the current reaching a predetermined percentage (e.g., 135 percent) of the rated current for a period of time to be determined by calibration of the unit. This elevated current level causes direct heating of a bimetal 28, which results in the bending of the bimetal 28. The bimetal 28 is composed of two dissimilar thermostat materials which are laminated or bonded together and which expand at different rates due to temperature increases, thereby causing the bimetal 28 to bend.

The rated current for the circuit breaker is the maximum current which can be carried by the circuit breaker under normal (steady-state) operating conditions. The rated current is the current the circuit breaker is designed to carry without tripping. In the preferred embodiment, the circuit breaker has a rated current of 250 amperes. In existing circuit breakers having a rated current of 250 amperes, a separate heater is used to heat the bimetal 28. An important feature of the thermal trip unit is that the bimetal 28 is directly heated. By directly heating the bimetal 28, the need for a separate heater is eliminated, thereby simplifying the design of the thermal trip unit and reducing the costs associated therewith.

The bimetal 28 is directly heated by attaching a lower portion of the bimetal 28 to an L-shaped load terminal 30 and by attaching two flexible connectors 32 (e.g., pigtails) to a lower to middle portion of the bimetal 28 (FIG. 1). In the preferred embodiment, the bimetal 28 is approximately 2.75 inches in length, and the flexible connectors 32 are connected by single phase A/C resistance or capacitive discharge methods to the bimetal 28 at a location slightly less than one inch from the lower end of the bimetal 28. This creates a direct current path from the load terminal 30 through the bimetal 28 and into the flexible connectors 32, which, in turn, allows the maximum energy (heat) to be utilized to deflect the bimetal 28. Direct heating of the bimetal 28 makes the trip unit more efficient by eliminating the losses that occur between a separate heater and a bimetal. In addition, the employed bimetal 28 will have a lower resistance due to the low attachment on the bimetal 28 of the flexible connectors 32, thereby-reducing the power consumed by the bimetal 28 and allowing the product to operate at cooler temperatures. This, in turn, increases customer satisfaction.

The amount of power and heat generated in the circuit breaker lugs (not shown) is directly proportional to both the current carried by the circuit breaker and the resistance of the current path through the circuit breaker. The arrangement of the load terminal 30, the bimetal 28, and the flexible connectors 32 is designed to prevent overheating of the circuit breaker lugs and, at the same time, permit the circuit breaker to properly trip in response to an overcurrent condition. In particular, the flexible connectors 32 are connected to the lower middle portion of the bimetal 28 so that the current path through the bimetal 28 is relatively short compared to the length of the bimetal 28. This short current path through the bimetal 28, in turn, insures that the bimetal 28 adds a relatively small resistance to the current path through the circuit breaker. Since the amount of heat generated in the circuit breaker lugs is directly proportional to the resistance of the current path through the circuit breaker, the short current path through the bimetal 28 minimizes the amount of heat generated in the lugs. At the same time, the resistance of the bimetal along this short current path is sufficient to properly bend the bimetal 28 during an overcurrent condition.

Figure 3:
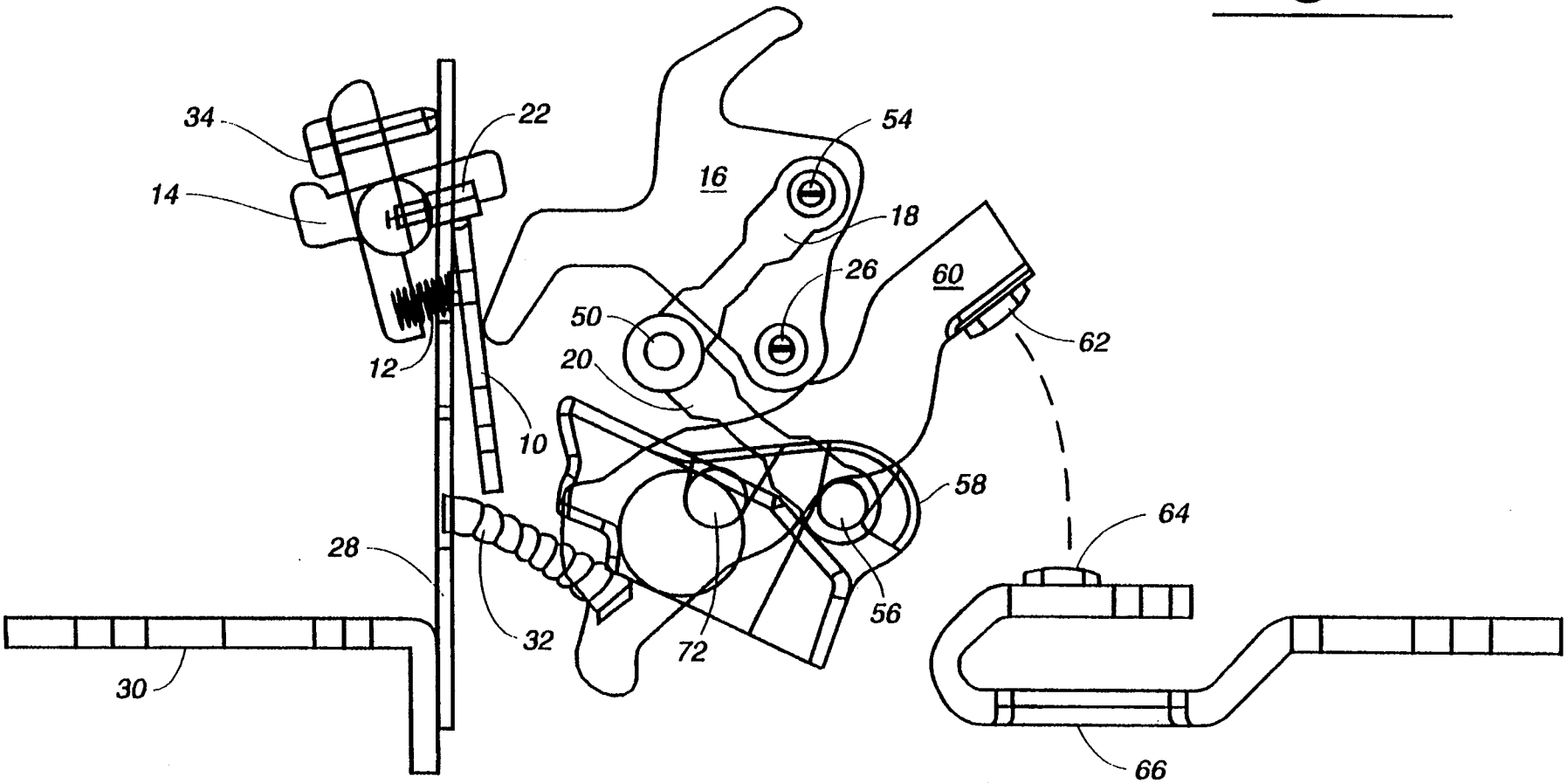
FIG. 3 is a side view of the thermal trip unit of the circuit breaker in FIG. 1, shown in the tripped position.
Figure 4:
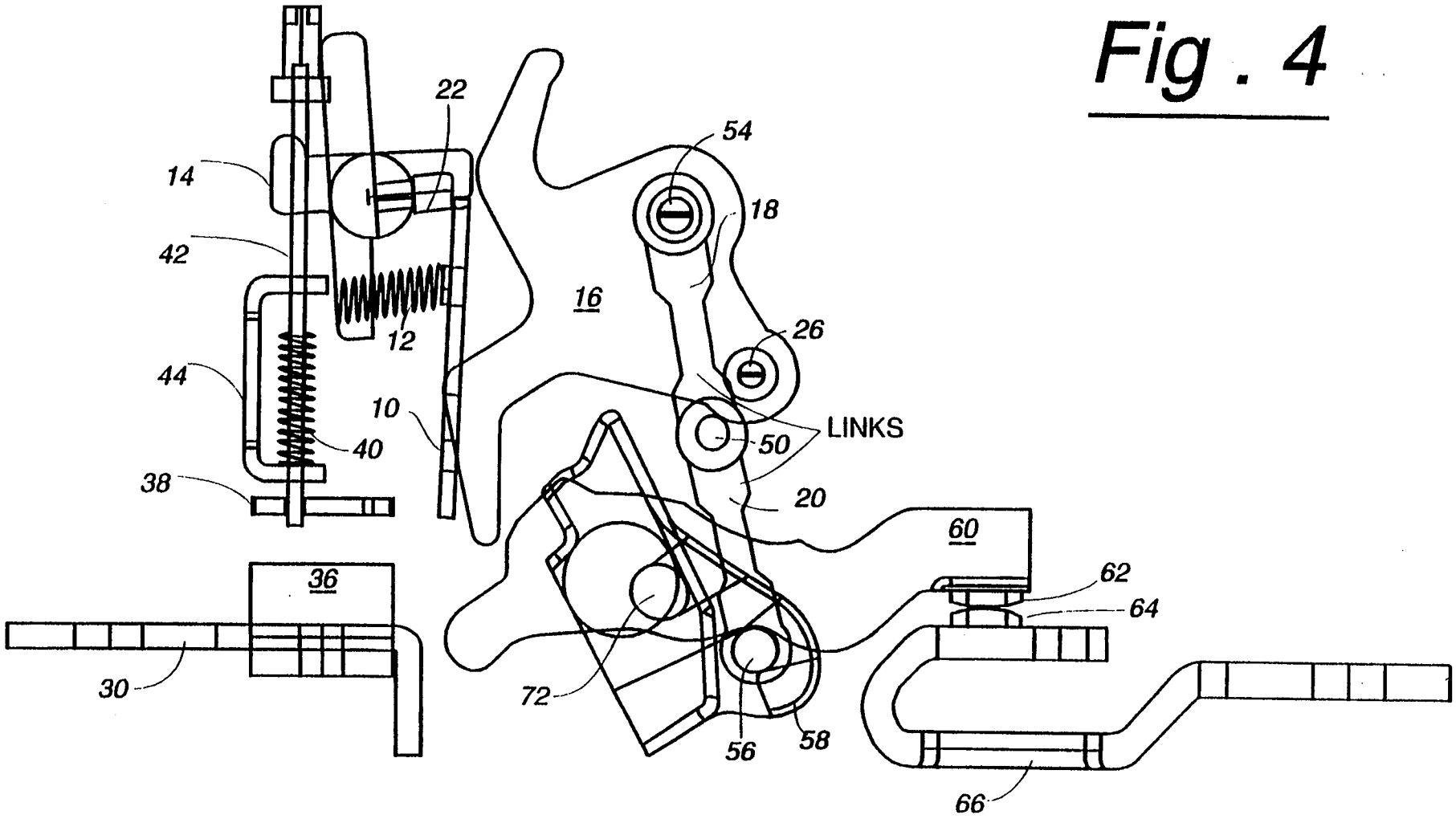
FIG. 4 is a side view of a magnetic trip unit of the circuit breaker in FIG. 1, shown in the untripped position.

As the bimetal 28 bends, it comes in contact with a trip screw 34 housed in the trip crossbar 14. The continued bending of the bimetal 28 forces the trip crossbar 14 to rotate in a counterclockwise motion (as viewed in FIGS. 2 and 3). This rotation of the trip crossbar 14 causes the latch pin 22 to rotate above the latch 10. With the latch pin 22 no longer in contact with the latch 10, the cradle 16 forces the latch 10 to rotate counterclockwise, thereby releasing the cradle 16. The cradle 16 then rotates clockwise and causes the circuit breaker to trip (FIG. 3).

Figure 5:
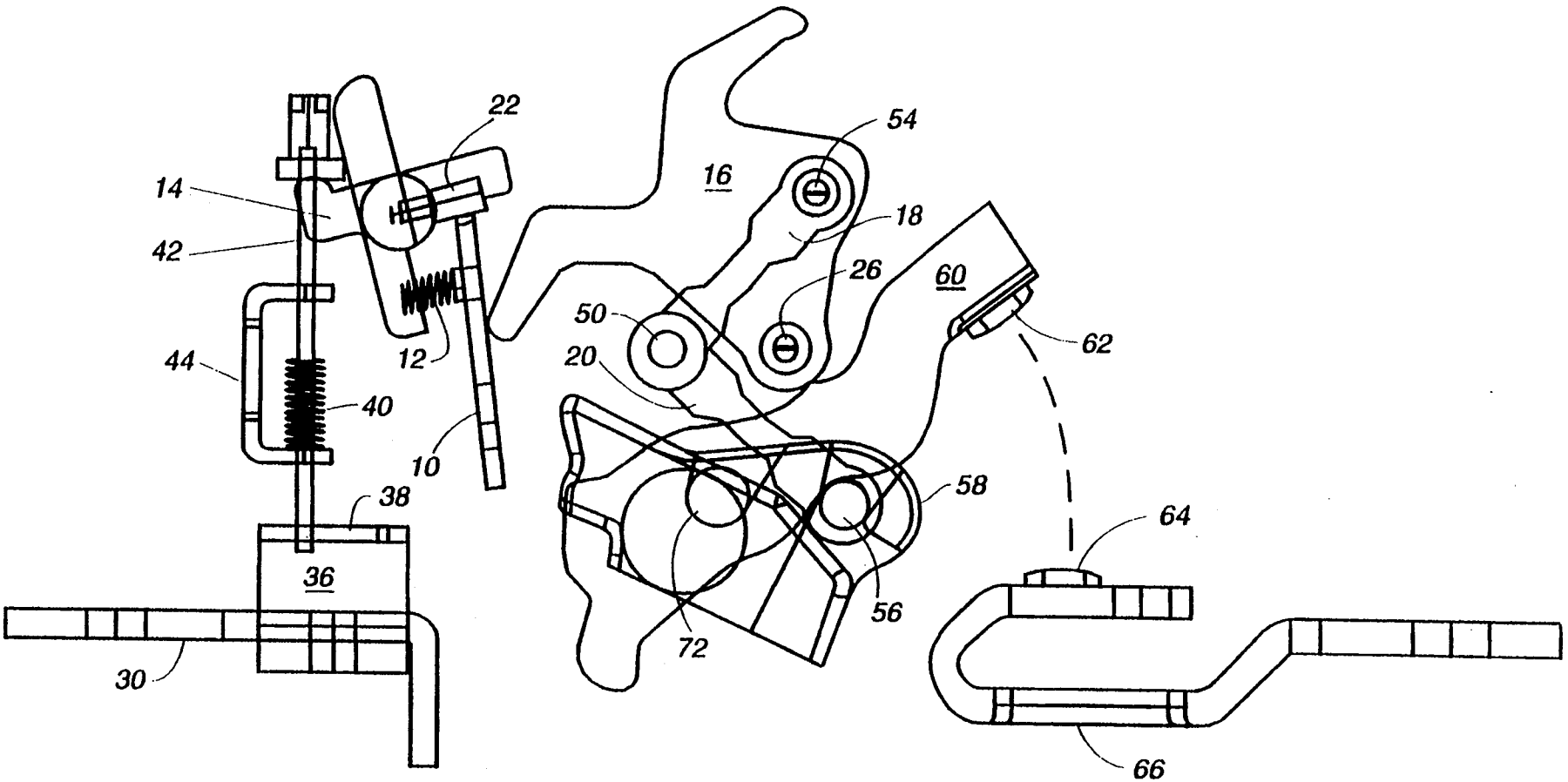
FIG. 5 is a side view of the magnetic trip unit of the circuit breaker in FIG. 1, shown in the tripped position.

With respect to the magnetic trip unit (FIGS. 4 through 7), the magnetic trip unit operates in response to the current flowing through the circuit breaker reaching a specified level, causing the circuit breaker to clear the interruption. The elevated current level causes the magnetic field in a U-shaped magnetic yoke 36 to increase. When the magnetic field is large enough such that the downward force caused by the magnetic attraction between the magnetic yoke 36 and an armature plate 38 is larger than the opposing force of a magnetic spring 40, the armature plate 38 is attracted to the magnetic yoke 36, thereby pulling an armature shaft 42 down. The armature shaft 42 is guided by an armature guide 44 having a slot for receiving the armature shaft 42. The movement of the armature shaft 42 causes the trip crossbar 14 to rotate in a counterclockwise motion (as viewed in FIGS. 4 and 5). This movement of the trip crossbar 14 rotates the latch pin 22 above the latch 10. With the latch pin 22 no longer in contact with the latch 10, the force from the cradle 16 onto the latch 10 causes the latch 10 to rotate counterclockwise, thereby releasing the cradle 16. The cradle 16 then rotates clockwise and causes the circuit breaker to trip (FIG. 5).

Figure 6:
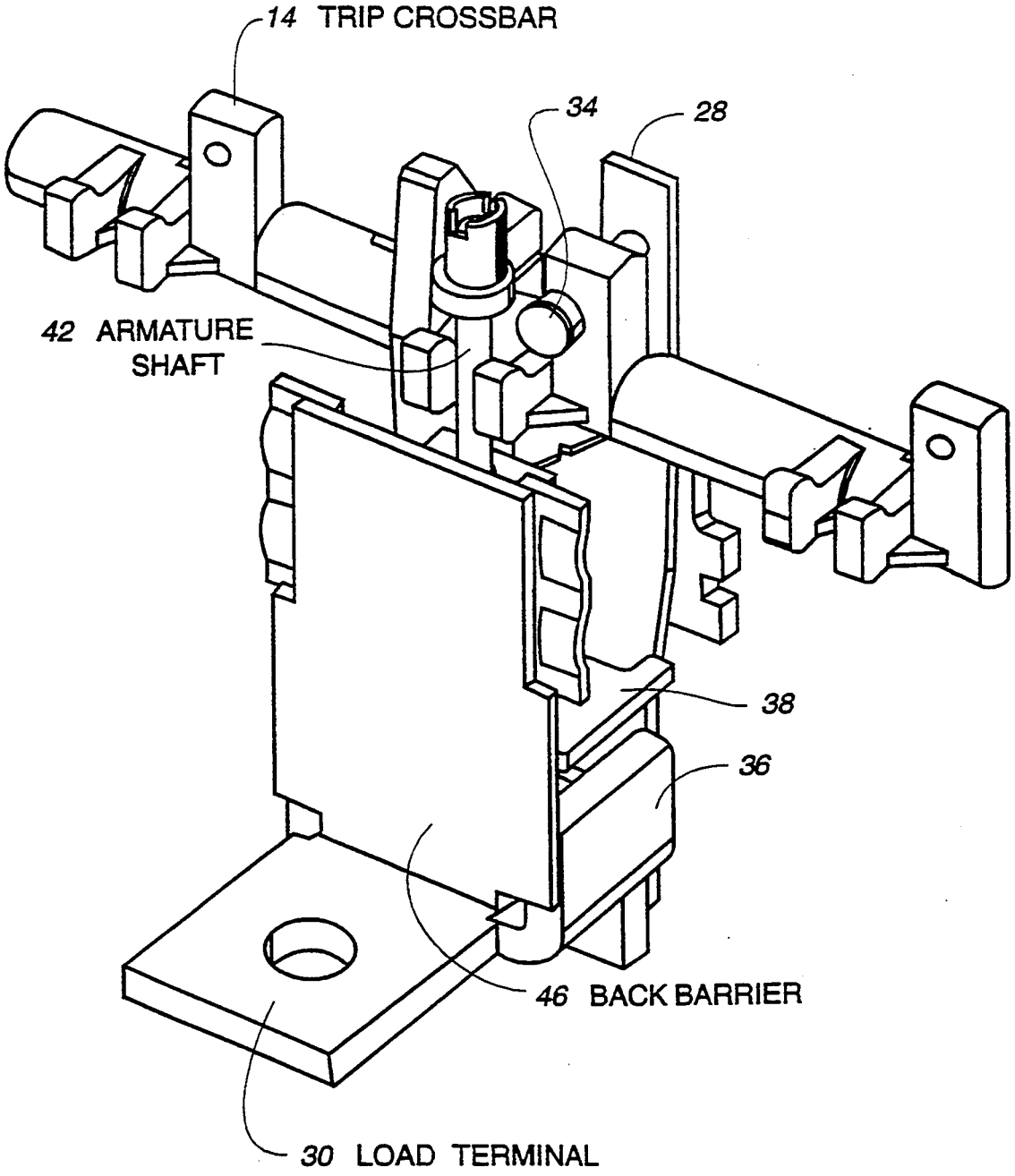
FIG. 6 is a perspective view of the thermal and magnetic trip units in FIGS. 2 through 5.
Figure 7:
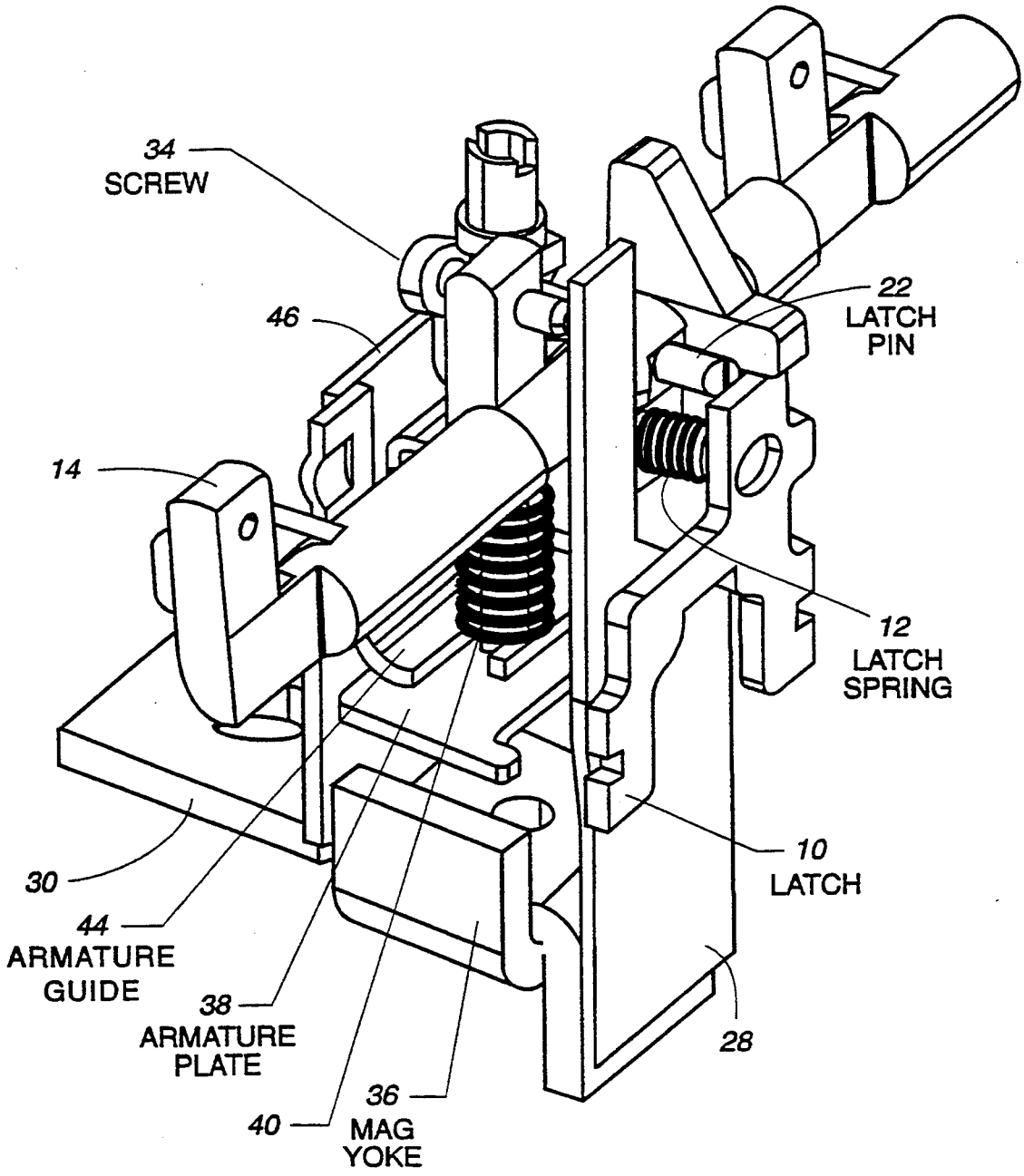
FIG. 7 is another perspective view of the thermal and magnetic trip units in FIGS. 2 through 5.

Referring to FIGS. 6 and 7, to prevent an operator from entering the circuit breaker enclosure by the load terminal 30 and touching the trip unit components, the circuit breaker is provided with a back barrier 46. The back barrier 46 and the armature guide 44 are preferably attached together using a spot weld. Alternatively, these two parts may be attached together using a TOX joint, or the back barrier 46 may be integrally formed with the armature guide 44 using a progressive die.

With respect to the blade/cradle assembly (FIGS. 8 through 13), when either the thermal trip unit or the magnetic trip unit cause the latch 10 to rotate counterclockwise and release the cradle 16, the force from a toggle spring 48, connected to a toggle pin 50 and a handle arm 52, causes the cradle 16 to rotate clockwise about a cradle pivot pin 54 (as viewed in FIGS. 8, 10, 12, and 13). The rotation of the cradle 16, in turn, causes the upper and lower links 18, 20 to collapse.

Figure 10:
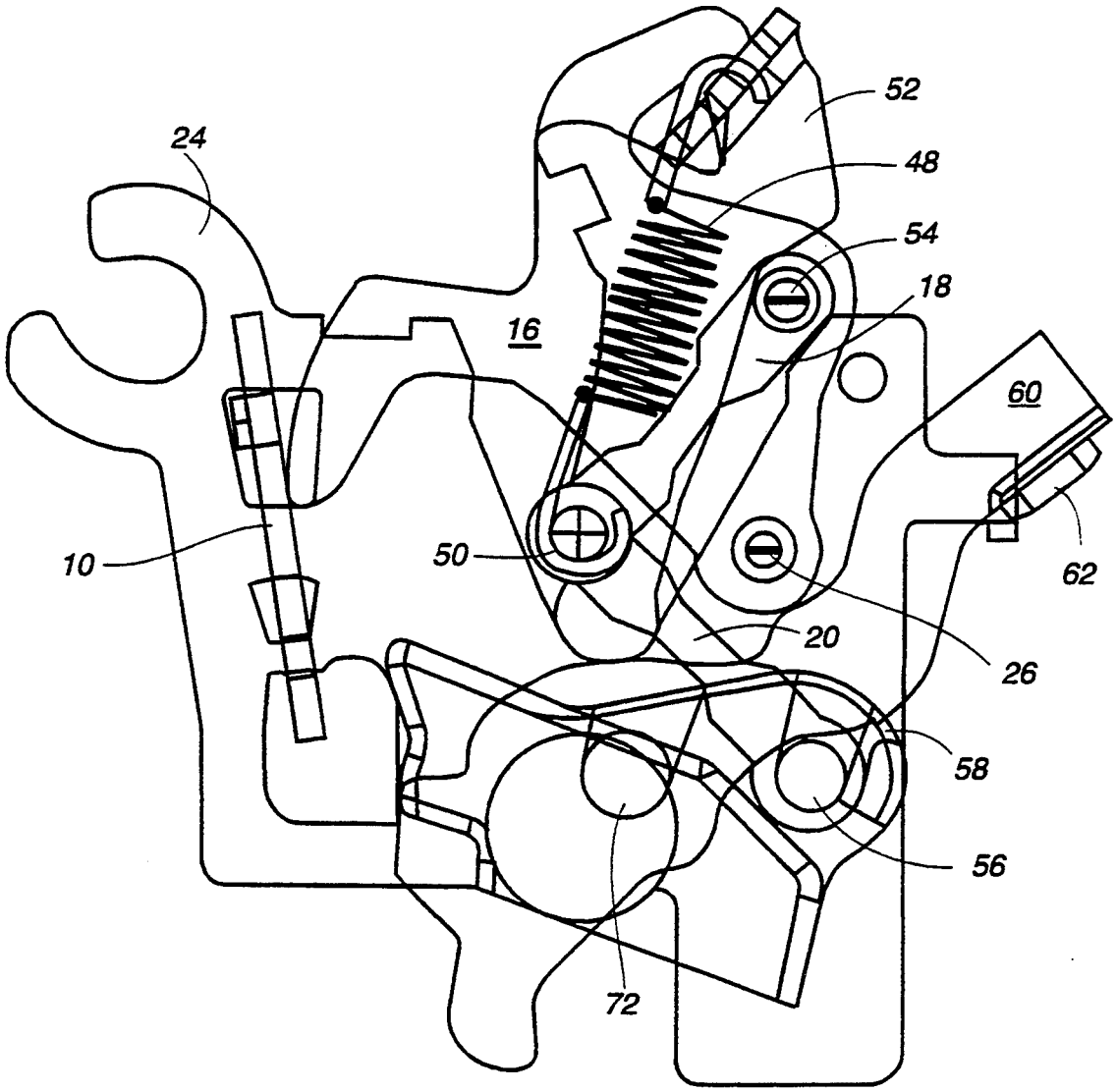
FIG. 10 is a side view of the blade/cradle assembly of the circuit breaker in FIG. 1, shown in the tripped position.
Figure 11:
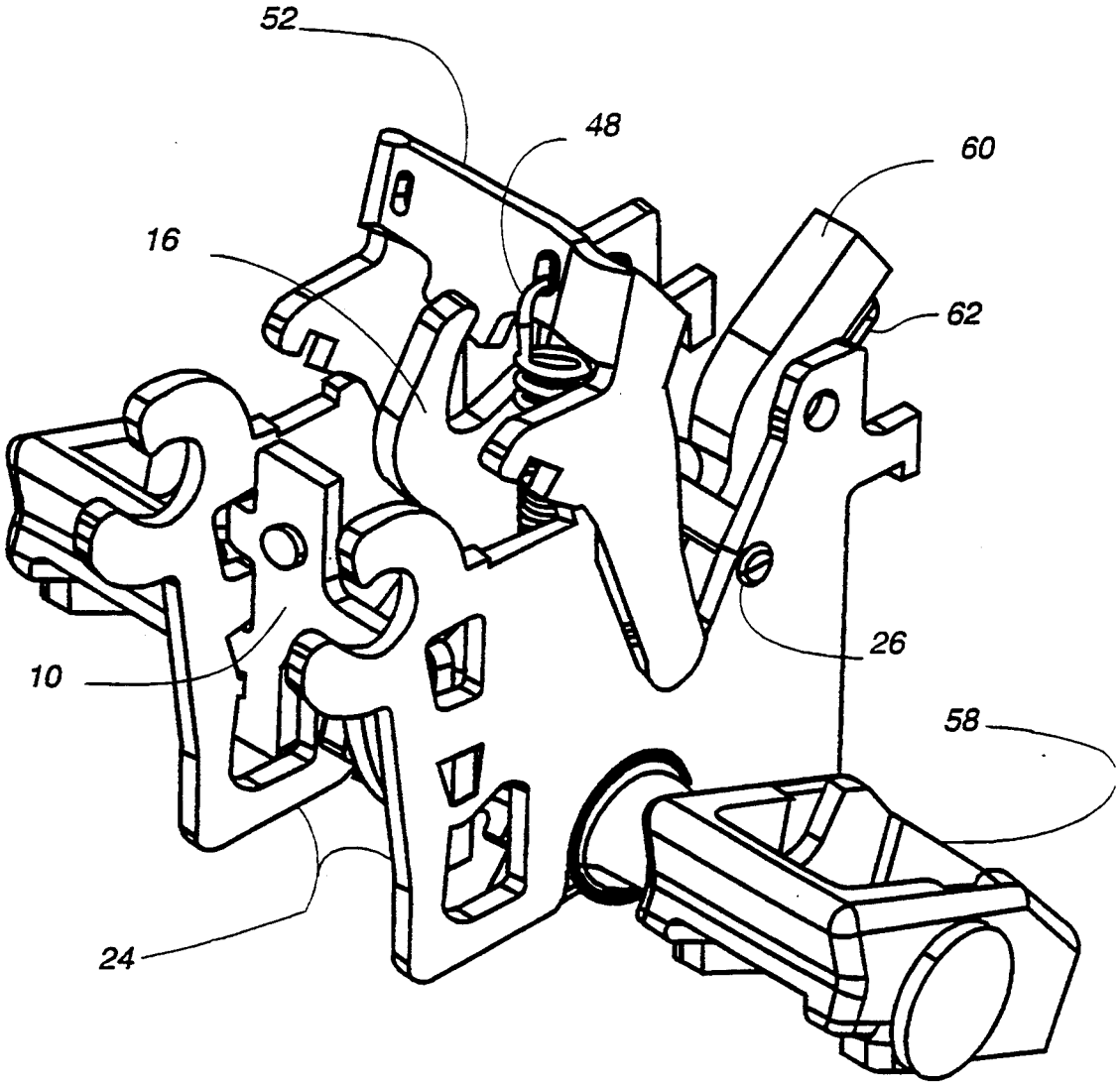
FIG. 11 is a perspective view of the blade/cradle assembly in FIG. 10, shown in the tripped position.

More specifically, the toggle pin 50 connects the two upper links 18 to the two lower links 20. As the cradle 16 rotates, the upper links 18 rotate clockwise about an upper link pin 54, thereby pulling the toggle pin 50 back and upward. This movement of the toggle pin 50 forces the lower links 20 to rotate counterclockwise about a drive pin 56 and pull up on a blade carrier or crossbar 58. The movement of the blade crossbar 58 forces an elongated blade 60 to rotate counterclockwise, thereby separating the contacts 62, 64 (FIGS. 10 and 11). The stationary contact 64 is depicted in FIGS. 2 through 5 and is mounted to a line terminal 66.

Figure 12:
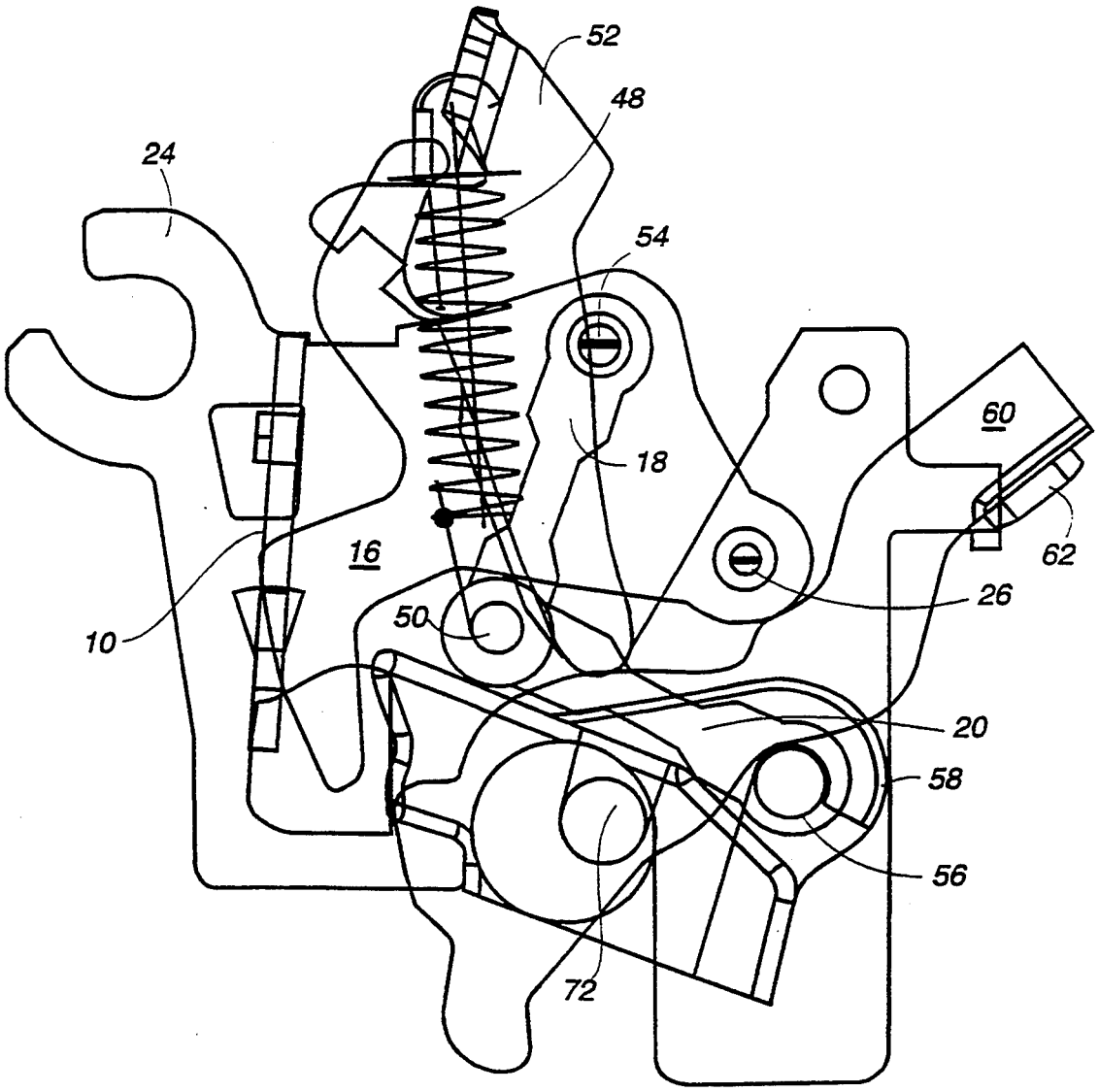
FIG. 12 is a side view of the blade/cradle assembly of the circuit breaker in FIG. 1, shown in the reset position.
Figure 13:
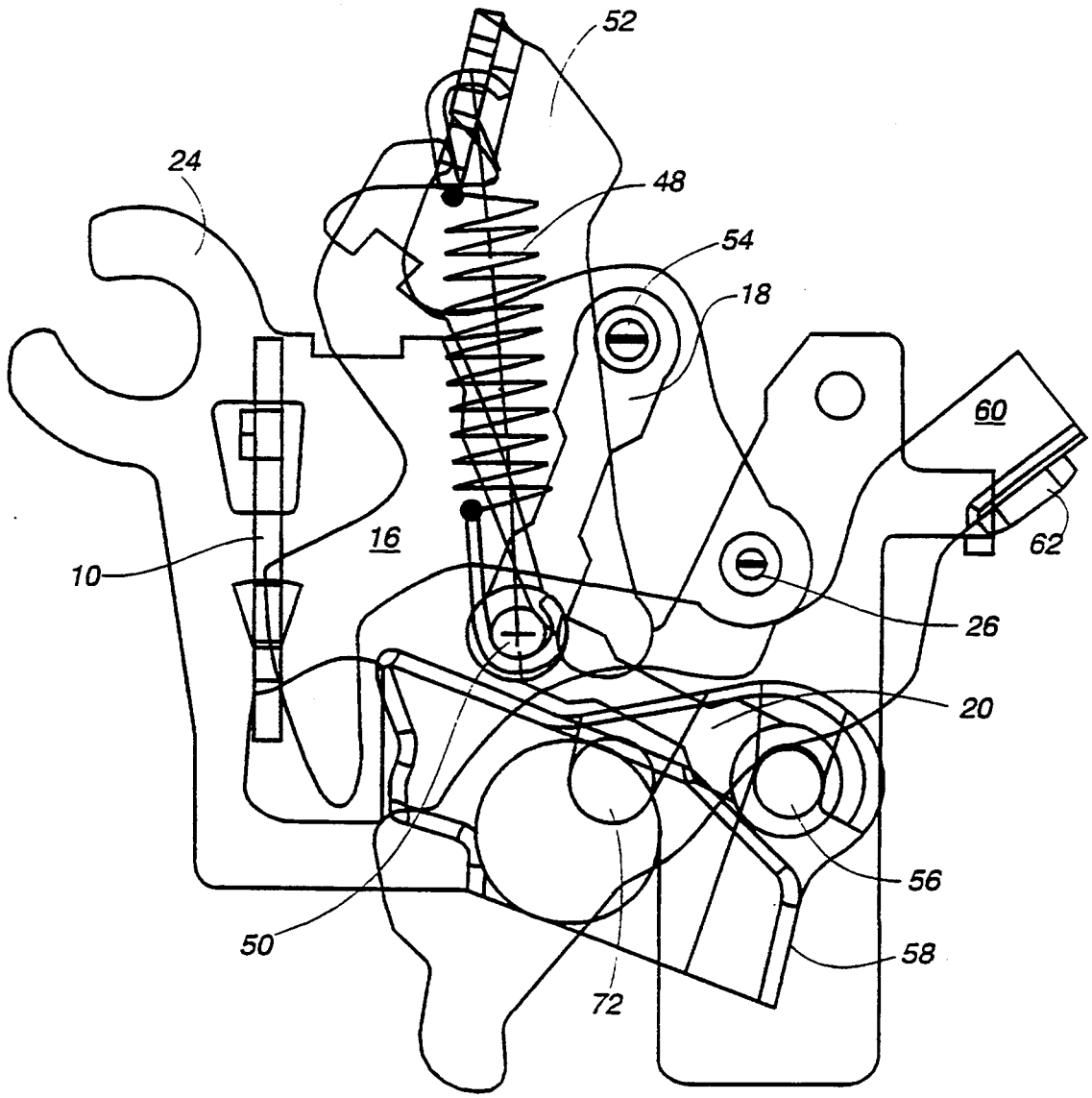
FIG. 13 is a side view of the blade/cradle assembly of the circuit breaker in FIG. 1, shown in the "off" position.

After the circuit breaker has been tripped (FIGS. 10 and 11), the latching system is reset by rotating the handle arm 52 counterclockwise. This movement of the handle arm 52 forces the cradle 16 to rotate counterclockwise until the cradle 16 has reached a reset position (FIG. 12). The reset position is the farthest point the handle arm 52 is able to rotate counterclockwise because the mechanism frame sides 24 restrict any further rotation of the handle arm 52. With the cradle 16 in the reset position, the latch spring 12 forces both the latch 10 and the trip crossbar 14 to simultaneously rotate clockwise. This brings the latch pin 22 in contact with the latch 10 so as to lock the latch 10 over the cradle 16 and reset the latching system. In response to the latching system being reset, the handle arm 52 rotates clockwise to an "off" position (FIG. 13).

Figure 8:
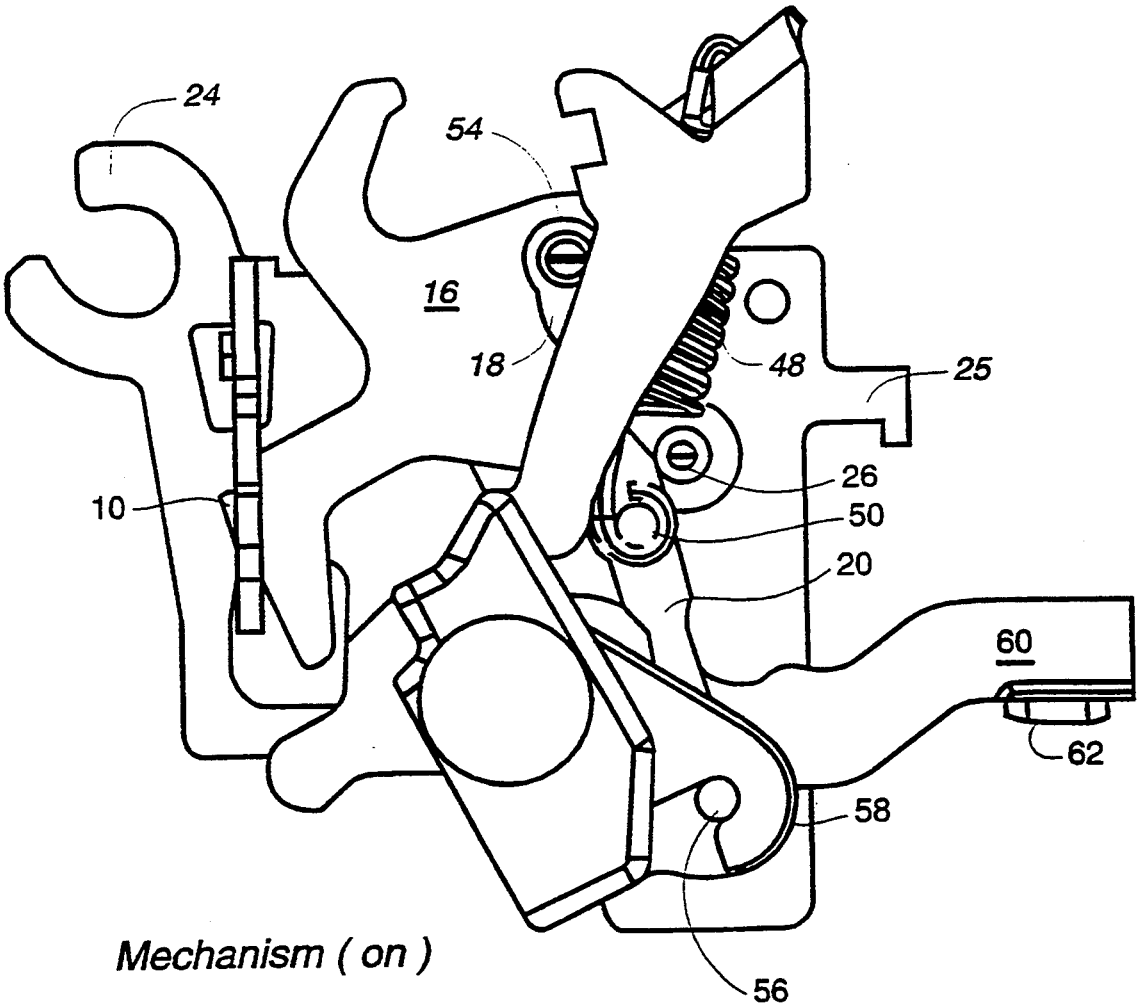
FIG. 8 is a side view of a blade/cradle assembly of the circuit breaker in FIG. 1, shown in the untripped position.

The circuit breaker is placed in an "on" operating mode by rotating the handle arm 52 clockwise to an "on" position (FIG. 8). The "on" position is the farthest point the handle arm 52 can be rotated clockwise. The mechanism frame sides 24 restrict further clockwise rotation of the handle arm 52 beyond the "on" position. As the handle arm 52 rotates clockwise, the toggle spring 48 pulls the toggle pin 50 forward to force the upper and lower links 18, 20 to rotate into alignment. This movement of the links 18, 20 forces the blade crossbar 58 to rotate clockwise, thereby allowing the blade 60 to close the contacts 62, 64. The cradle pivot pin 26 prevents the upper and lower links 18, 20 from rotating beyond the aligned position.

Figure 15:
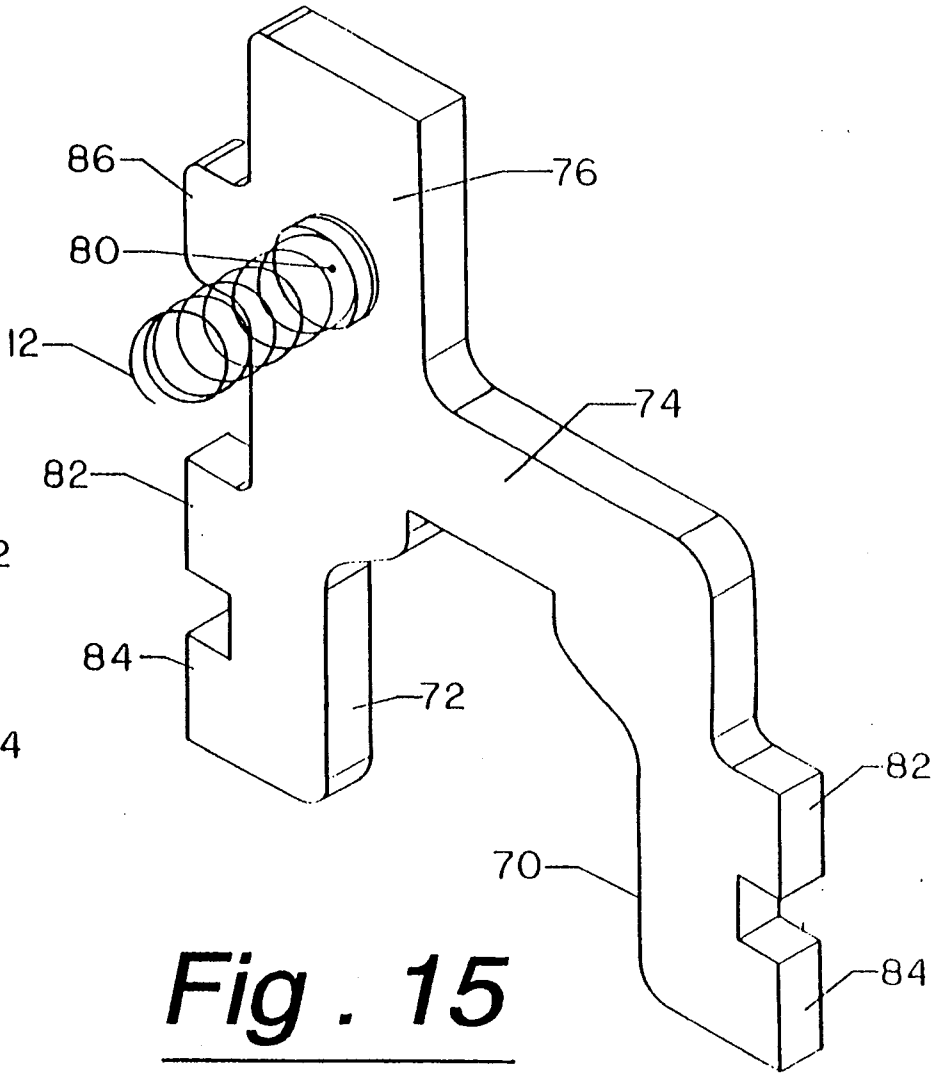
FIG. 15 is another perspective view of the latch in FIG. 14, showing the opposite side thereof.
Figure 14:
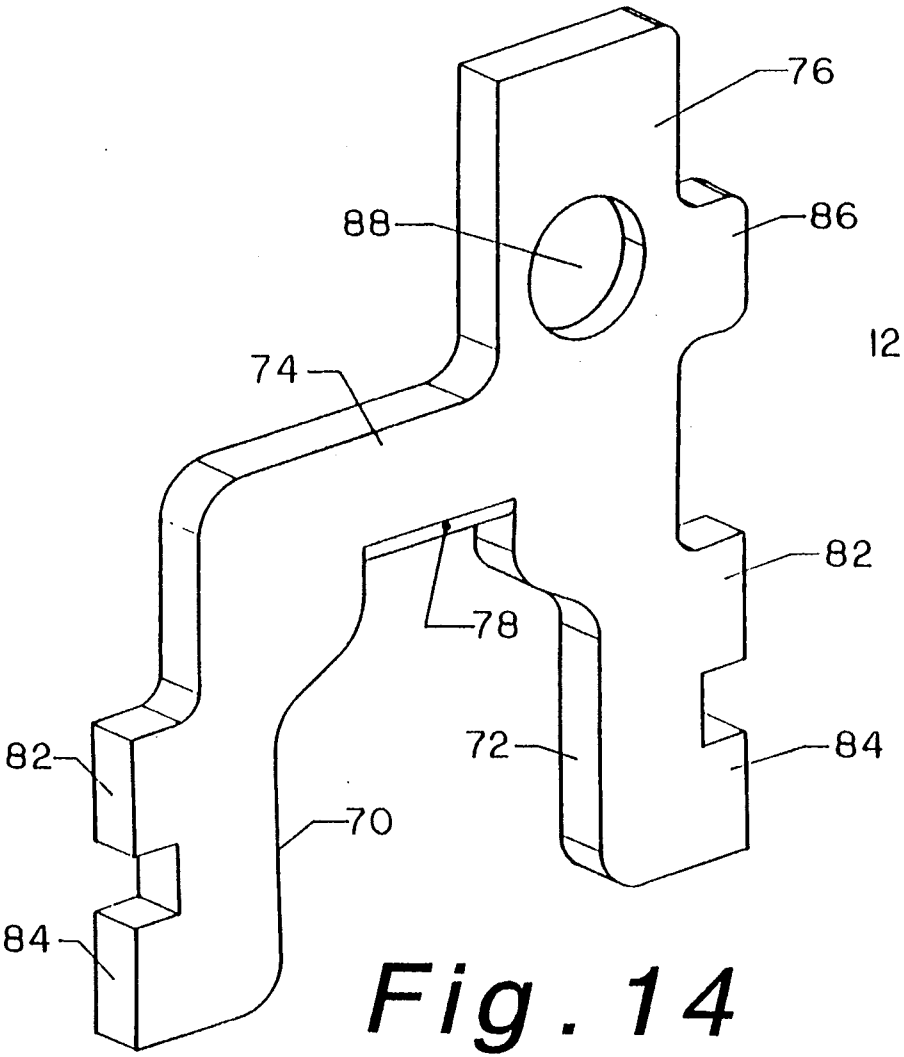
FIG. 14 is a perspective view of the latch embodying the present invention.

Referring now to FIGS. 14 and 15, the latch 10 is incorporated in the latching system of FIGS. 2 through 7. The latch 10 is configured in the form of a lower case "h". In accordance with this configuration, the latch 10 includes a pair of longitudinal legs 70, 72, a lateral section 74 bridging the pair of longitudinal legs 70, 72, and a longitudinal section 76 extending from the lateral section 74 in an opposite direction relative to the pair of legs 70, 72.

The lateral section 74 includes a lower bearing surface 78 for releasably engaging the cradle 16 of the circuit breaker. The lower bearing surface 78 has a coined radius for facilitating engagement and disengagement of the cradle 16. This coined radius extends from the side of the latch 10 which faces toward the cradle 16 (i.e., right-side of the latch 10 in FIGS. 2 through 5). The longitudinal section 76 includes a cylindrical protrusion 80 for supporting the latch spring 12. This protrusion 80 extends outwardly from the side of the latch 10 which faces away from the cradle 16 and faces toward the armature shaft 42 (i.e., left-side of the latch 10 in FIGS. 2 through 5). As shown in FIG. 15, one end of the latch spring 12 is press fit to the protrusion 80.

Figure 9:
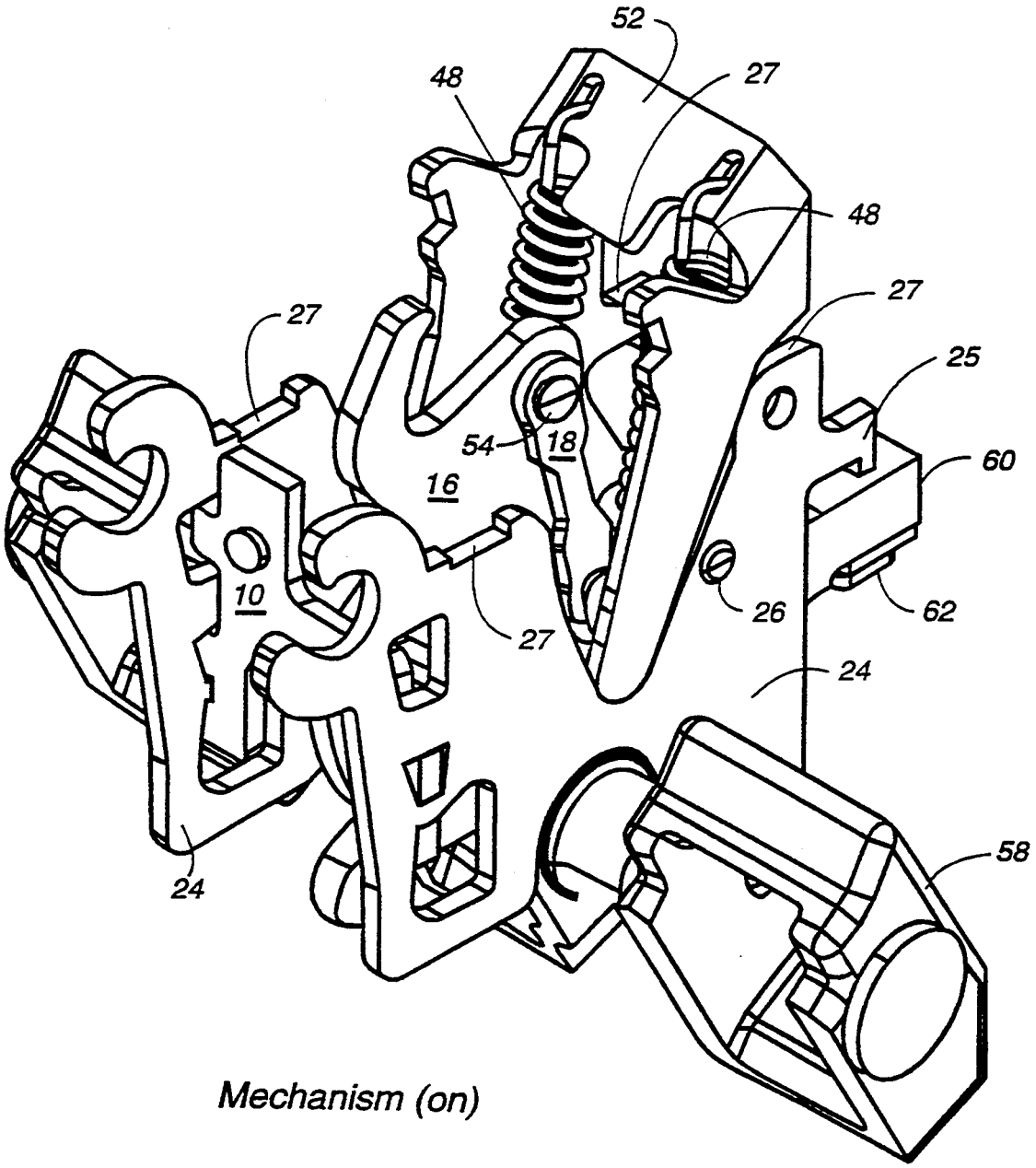
FIG. 9 is a perspective view of the blade/cradle assembly in FIG. 8, shown in the untripped position.

Each of the legs 70, 72 of the latch 10 includes a pair of orthogonal tabs 82, 84, and the longitudinal section 76 includes an orthogonal tab 86. As best shown in FIGS. 9 and 11, these tabs secure the latch 10 to the pair of mechanism frame sides 24 so as to maintain the legs 70, 72 in alignment with each other (as viewed in FIGS. 2 through 5) while the latch 10 is tripped. Thus, the tabs 82, 84, and 86 stabilize the movement of the latch 10.

The latch 10 is manufactured in a single stamping operation, during which the protrusion 80 is formed by cold extrusion. As shown in FIG. 14, the cold extrusion formation of the protrusion 80 on one side of the latch 10 results in an indentation 88 on the other side of the latch 10. The depth of the indentation 88 corresponds to the depth of the protrusion 80. The use of a single stamping operation to form the entire latch 10 tightly controls the manufacturing tolerances associated with the coined radius of the bearing surface 78 and the protrusion 80. It is important that the coined bearing surface 78 be properly formed because it is this surface 78 which makes contact with the cradle 16. If the coined radius is incorrect, the latch 10 could fail to properly release the cradle 16 in response to being tripped or could fail to properly hold the cradle 16 during normal operating conditions. Furthermore, it is important that the protrusion 80 be formed with such a depth that it can properly support one end of the latch spring 12. Since the use of a single stamping operation tightly controls the manufacturing tolerances associated with the bearing surface 78 and the protrusion 80, these elements of the latch 10 are properly formed. The use of a single stamping operation also reduces production costs and increases production rates.

While the invention has been particularly shown and described with reference to certain embodiments, it will be recognized by those skilled in the art that modifications and changes may be made to the present invention. Each of these embodiments and obvious variations thereof is contemplated as falling within the spirit and scope of the claimed invention, which is set forth in the following claims.

What is claimed is:

1. A latch mechanism for a circuit breaker, comprising:

a pair of longitudinal legs;

a lateral section bridging said pair of longitudinal legs, said lateral section including a lower beating surface for releasably engaging a cradle of the circuit breaker, said lower bearing surface being curved to facilitate engagement and disengagement of the cradle from said beating surface; and a longitudinal section extending from said lateral section in an opposite direction relative to said pair of legs, said longitudinal section including an extrusion for supporting a latch spring.

2. The latch mechanism of claim 1, wherein said pair of longitudinal legs each include at least one orthogonal tab for securing the latch mechanism to frame sides of the circuit breaker.

3. The latch mechanism of claim 2, wherein said longitudinal section includes a tab for securing the latch mechanism to one of the frame sides of the circuit breaker.

4. The latch mechanism of claim 1, wherein said curved lower bearing surface includes a coined radius.

5. The latch mechanism of claim 4, wherein said extrusion and said coined radius extend from opposite sides of said longitudinal section.

6. The latch mechanism of claim 1, wherein said extrusion forms an indentation on one side of said longitudinal section and a protrusion on an opposite side of said longitudinal section, said protrusion being in line with said indentation.

7. The latch mechanism of claim 6, wherein said extrusion is cylindrically shaped.

8. A method of manufacturing a latch mechanism for a circuit breaker, comprising:

stamping a piece of raw material to form a configuration including a pair of longitudinal legs, a lateral section bridging the pair of longitudinal legs, and a longitudinal section extending from the lateral section in an opposite direction relative to the pair of legs;

while stamping the piece of raw material, extruding the longitudinal section to form a protrusion for supporting a latch spring; and while stamping the piece of raw material, forming a curved lower beating surface on the lateral section for releasably engaging a cradle of the circuit breaker.

9. The manufacturing method of claim 8, wherein said step of extruding the longitudinal section forms an indentation disposed in line with the protrusion and located on an opposite side of the longitudinal section relative to the protrusion.

10. The manufacturing method of claim 8, wherein said step of forming a curved lower bearing surface on the lateral section includes coining a radius on the lower bearing surface.

* * * * *